US010351396B2

(12) United States Patent
Nielsen

(10) Patent No.: US 10,351,396 B2
(45) Date of Patent: Jul. 16, 2019

(54) APPARATUS AND METHOD FOR REPLACING CABLE OR WIRE IN A HOISTING SYSTEM

(71) Applicant: MHWIRTH AS, Kristiansand S (NO)

(72) Inventor: Ragnar Nielsen, Kristiansand (NO)

(73) Assignee: MHWIRTH AS, Kristiansand S (NO)

( * ) Notice: Subject to any disclaimer, the term of this patent is extended or adjusted under 35 U.S.C. 154(b) by 73 days.

(21) Appl. No.: 15/503,407

(22) PCT Filed: Jul. 8, 2015

(86) PCT No.: PCT/NO2015/050126
§ 371 (c)(1),
(2) Date: Feb. 13, 2017

(87) PCT Pub. No.: WO2016/024866
PCT Pub. Date: Feb. 18, 2016

(65) Prior Publication Data

US 2017/0225929 A1 Aug. 10, 2017

(30) Foreign Application Priority Data

Aug. 15, 2014 (NO) ..... 20140991

(51) Int. Cl.
*B66D 1/26* (2006.01)
*B66D 3/04* (2006.01)
(Continued)

(52) U.S. Cl.
CPC ..... *B66D 1/26* (2013.01); *B66D 3/043* (2013.01); *B66D 3/06* (2013.01); *E21B 19/008* (2013.01);
(Continued)

(58) Field of Classification Search
CPC ..... E21B 19/008; E21B 19/02; B66D 1/26; B66D 3/043; B66D 3/06; B66D 2700/035
See application file for complete search history.

(56) References Cited

U.S. PATENT DOCUMENTS 3,973,435 A * 8/1976 Decker ..... B66D 1/30 73/862.393
4,789,136 A * 12/1988 Connelly ..... B66D 1/34 254/391

(Continued)

*Primary Examiner* — Sang K Kim
*Assistant Examiner* — Nathaniel L Adams
(74) *Attorney, Agent, or Firm* — Norman B. Thot

(57) ABSTRACT

A method for replacing a length of a wire/cable in a hoisting system. The wire/cable extends from a storage drum to a winch. The method includes removing at least one lock which prevents a deadline anchor arranged between the storage drum and the winch from rotating, reeling onto the storage drum a first length of the wire/cable with a simultaneous coordinated operation of the deadline anchor and the storage drum, the simultaneous coordinated operation being controlled so that the wire/cable is in a continuous tension between the deadline anchor and the storage drum, securing the wire/cable to an attachment point, cutting a section of the wire/cable between the attachment point and the winch and removing the cut section of the wire/cable, reattaching the wire/cable remaining to the winch, reeling out a second length of the wire/cable from the storage drum, and securing the wire/cable to the deadline anchor.

5 Claims, 9 Drawing Sheets

(51) Int. Cl.

| | |
|---|---|
| ***E21B 19/00*** | (2006.01) |
| ***E21B 19/02*** | (2006.01) |
| ***B66D 3/06*** | (2006.01) |

(52) U.S. Cl.
CPC ..... *E21B 19/02* (2013.01); *B66D 2700/035* (2013.01)

(56) References Cited

U.S. PATENT DOCUMENTS

| | | | |
|---|---|---|---|
| 4,836,300 | A | 6/1989 | Reed |
| 4,903,443 | A | 2/1990 | Reed |
| 2006/0231813 | A1 | 10/2006 | Welsh |
| 2014/0034887 | A1 | 2/2014 | Fetters, III et al. |

* cited by examiner

APPARATUS AND METHOD FOR REPLACING CABLE OR WIRE IN A HOISTING SYSTEM

CROSS REFERENCE TO PRIOR APPLICATIONS

This application is a U.S. National Phase application under 35 U.S.C. § 371 of International Application No. PCT/NO2015/050126, filed on Jul. 8, 2015 and which claims benefit to Norwegian Patent Application No. 20140991, filed on Aug. 15, 2014. The International Application was published in English on Feb. 18, 2016 as WO 2016/024866 A1 under PCT Article 21(2).

FIELD

The present invention relates to a method and to an apparatus for changing drill wire or cable in a hoisting system in a derrick on an installation (platform) offshore or onshore.

BACKGROUND

Onshore or offshore drilling rigs are used in exploration, drilling and production of hydrocarbons. The drilling rigs include a derrick or a mast with a hoisting system for lifting and lowering of pipes and other equipment into or out of the well. The hoisting system typically consists of a wire or cable, a so-called drill-line, a crown block at the top of the derrick or mast, and a traveling block both with a number of sheaves, a drawworks, a deadline anchor, and a drilling storage drum for wire or cable. The storage drum and the deadline anchor in such a hoisting system will usually be arranged on one side of a derrick or mast, while the drawworks will be arranged on the opposite side of the derrick or mast, where a wire or cable then will run from the storage drum and deadline anchor on one side of the derrick, over a number of sheaves in the derrick or mast, and onwards to the drawworks on the other side of the derrick or mast.

One challenge with such a hoisting system is that individual sections of the wire or cable will, after a period of use, be exposed to more wear than other sections. This is due to the fact that, due to reciprocating motion, the wire or cable comes into contact with the sheaves in the crown block and the traveling block along the same wire sections a large fraction of the operating time. The wear is greatest where the wire or cable rolls on and off the sheaves in the crown block and traveling block with large loads, especially at the lower position for the traveling block due to high load from the acceleration and retardation force. This wear leads to the entire wire or cable needing to be replaced after a time in use in order to avoid the risk of the system crashing or a major breakdown of the hoisting system as a result of wireline or cable breakage. An alternative to replacing the entire wire or cable is to perform a so-called "cut and slip" operation. In such an operation or procedure, a predetermined length of wire or cable is manually reeled off from the drawworks drum and stored temporarily on the drillfloor or another nearby area, and the reeled off wire or cable is cut close to the drawworks drum. The remaining length of wire or cable left on drawworks drum, is then removed for disposal. The reeled off, temporararily stored wire or cable is then reeled onto the drawworks drum, and the wire or cable can be loosened from its locking clamp on the deadline anchor so that new wire or cable is reeled off from the storage drum, over the deadline anchor and sheaves, and onto the drawworks drum with a length corresponding to the length of the wire or cable which was cut and disposed of. The deadline wire or cable is then locked onto the deadline anchor.

When the wire or cable must be replaced, which must occur after a certain number of ton-miles (ton-miles being the sum of all loads in tons and the distance hoisted or lowered in miles) to prevent fatigue and/or too high wear of the wire or cable, this is currently done manually and involves a large number of the drilling crew.

Depending on the type of operation, replacement of sections of wire or cable is done approximately on a weekly basis in order to ensure that all possible high-stress wireline sections or vulnerable points on the wire or cable are moved along the drill line wire or cable to a less exposed location. The most highly stressed locations for such fatigue or high wear are in the curve of the respective sheaves when a traveling block in the hoisting system is in one of its two end positions, i.e., when the block is close to a drill floor or near the derrick top.

The present manual operation requires that a large number of people (typically around six persons) must manually pull/tension the wire or cable during reeling off or on to thereby replace wire or cable on one or more drums of the drawworks.

A need therefore exists for an improved method and apparatus to change the wire or cable in a hoisting apparatus, in particular for "cut and slip" operations in order to reduce personnel involved in the operation and at the same time to increase safety and efficiency.

SUMMARY

An aspect of the present invention is to prevent personal injuries on a drill floor and to enable a more efficient and more secure execution of "cut and slip" operations.

Another aspect of the present invention is to reduce the need for manual labor during "cut and slip" operations, and to obtain a more protective handling of the wire or cable, A further aspect of the present invention is to provide the most correct reeling of the wire or cable on both the drawworks drum and storage drum without requiring a manual handling of the wire or cable on the respective drums and/or temporary storage areas for the wire or cable.

In an embodiment, the present invention provides a method for replacing a length of a wire or cable in a hoisting system. The wire or cable extends from a storage drum at a first end to a winch at a second end. The method includes removing at least one lock which prevents a deadline anchor arranged between the storage drum and the winch from rotating, reeling onto the storage drum a first length of the wire or cable with a simultaneous coordinated operation of the deadline anchor and the storage drum, the simultaneous coordinated operation being controlled so that the wire or cable is in a continuous tension between the deadline anchor and the storage drum, securing the wire or cable to an attachment point, cutting a section of the wire or cable between the attachment point and the winch and removing the cut section of the wire or cable, reattaching the wire or cable remaining to the winch, reeling out a second length of the wire or cable from the storage drum, and securing the wire or cable to the deadline anchor.

BRIEF DESCRIPTION OF THE DRAWINGS

The present invention is described in greater detail below on the basis of embodiments and of the drawings in which:

FIG. 4 shows steps in a "cut and slip" procedure according to the present invention including where the remaining length of the wire or cable on the winch is reeled off and disposed of;

DETAILED DESCRIPTION

Figure 1:
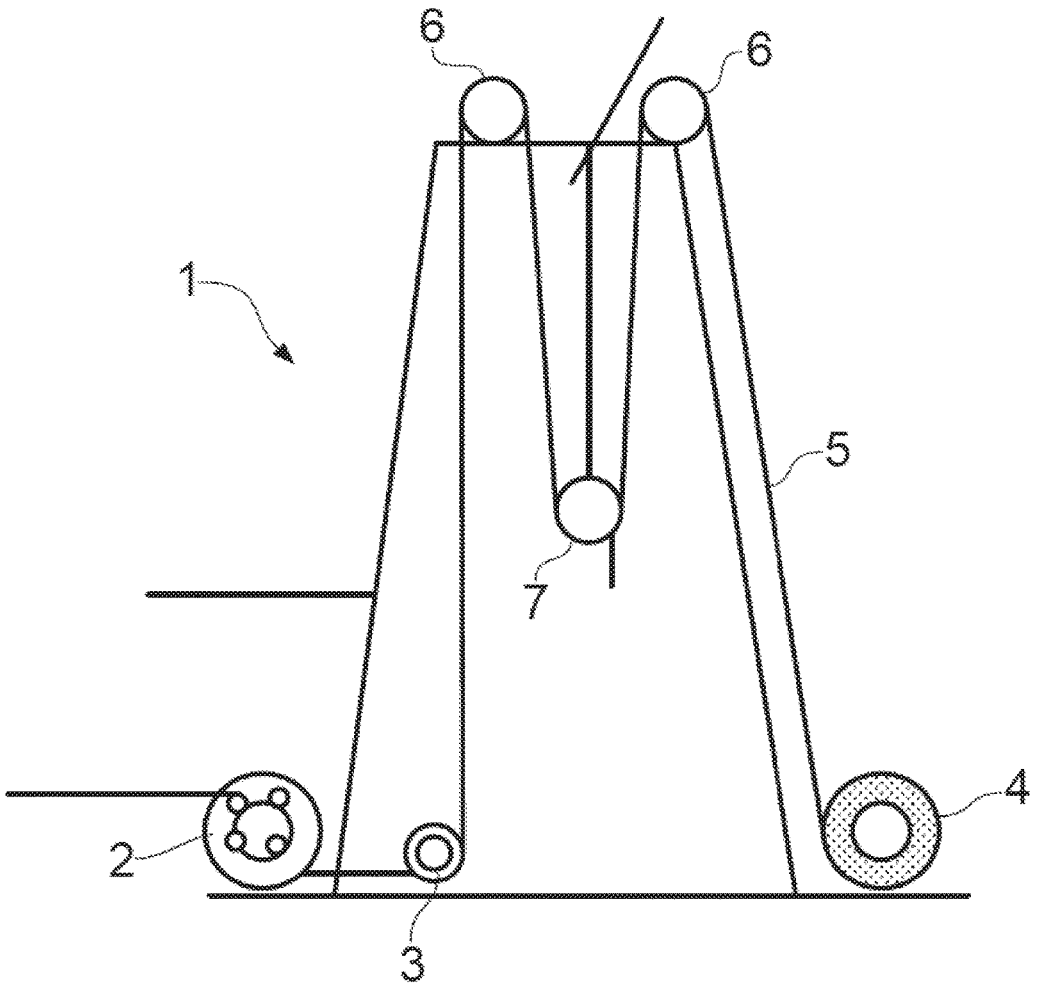
FIG. 1 shows a schematic diagram of a drilling tower with a hoisting system according to the present invention.

The present invention relates to a method and to an apparatus for the replacement of a wire or cable of a hosting system. The described method and apparatus are applicable both to upgrade existing hoisting systems and for new hoisting systems which are installed on a drilling installation (platform) offshore or onshore.

A "cut and slip" procedure according to the present invention may typically include at least some of the following steps:

Releasing load from a wire or cable by hanging off a traveling block and a drilling machine in a dedicated relief wire, which is mounted in a derrick, so that the wire or cable is not subjected to a load other than its own weight.

Dismantling locking bolts from a deadline anchor, which prevent the deadline anchor from rotating, and then releasing the wire or cable from the deadline anchor wire or cable lock.

Using a drive on the deadline anchor to reel the wire or cable off a winch drum and onto a storage drum. The drive of the storage drum is adjusted to keep the wire or cable between the deadline anchor and storage drum substantially tensioned. One person can thereby operate both the drive on the deadline anchor and the driving of the storage drum.

Reeling the wire or cable back onto the storage drum until a minimum number of turns of wire or cable is left on the winch drum. Approximately 60 m of wire or cable can, for example, be reeled back onto the storage drum whereupon approximately 5 turns will usually be left on the winch drum, which is equivalent to approximately 30 m.

Securing the wire or the cable to the derrick and preparing to cut. The free end of the wire or cable after the cut must be long enough to allow installation in a wire or cable lock arranged on the winch drum.

Reeling off and disposing of the remaining "old" wire or cable left on the winch drum.

Installing the free end of the wire or cable in the winch drum wire or cable lock.

Reeling the wire or cable onto the winch drum from the storage drum via the deadline anchor. This will correspond to about 5 turns, as well as the length of wire or cable required to lower the drilling machine and traveling block down to the drill floor from the point of suspension, which is normally about 90 m. The adjusting of the hydraulic pressure on the storage drum motor provides that the wire or cable is kept tensioned during the operation.

Locking the wire or cable to the deadline anchor with one or more locking clamps. The deadline anchor is locked by installing the locking bolts.

Releasing the travelling block and drilling machine from the hang off wire.

The hoisting system is operative.

The present invention also relates to an arrangement for a winch, the arrangement comprising a storage drum and a deadline anchor where the storage drum and the deadline anchor are arranged on a deadline side of an hoisting system and wherein a winch is further provided on a fastline side of the hoisting system, where a wire or cable, via the hoisting system, extends from the winch and to the storage drum, via the deadline anchor, where the storage drum comprises a drive for reeling wire or cable on or off the storage drum, while the deadline anchor comprises a drive allowing rotation of the deadline anchor in both rotational directions for a coordinated operation with the reeling on or off the storage drum.

In an embodiment of the present invention, the storage drum can, for example, include a motorized drive to reel on and to reel off the wire or cable from the storage drum, while the deadline anchor may include a motorized drive allowing rotation of the deadline anchor in both rotational directions (clockwise and counter-clockwise) so as to provide a coordinated operation with reeling and unreeling of wire or cable from the storage drum.

In an embodiment of the present invention, the motorized drive for the drum and the deadline anchor can, for example, be connected to a common hydraulic system which may further be connected to a common control device.

The motorized drive for the storage drum and/or the deadline anchor can, for example, be one or more hydraulic motors, hydraulic brakes, or the like.

In an embodiment of the present invention, the deadline anchor can, for example comprise a drum, a base, and one or more locking devices.

The present invention provides a method of replacing at least parts of a wireline or cable length of a hoisting system, such as a drill line, where the wire or cable extends from a storage reel at one end and to a winch in the other end, comprising the steps of:

a) suspending a traveling block (7) in a predetermined position in a derrick (1) and removing locks which prevent a deadline anchor (3) from rotating;

b) reeling onto the storage drum (2) a first length of wire or cable (5) with the simultaneous coordinated operation of the deadline anchor (3) and storage drum (2), where the operation is controlled so that the wire or cable (5) is in continuous tension between the deadline anchor (3) and the storage drum (2);

c) securing an end of the wire or cable (5) to an attachment point (9) in the derrick (1) in preparation for cutting the wire or cable (5) in a section of the wire or cable between the attachment point (9) and the winch (4);

d) cutting the wire or cable (5) and discarding the cut wire or cable (5);

e) attaching the remaining wire or cable (5) to the winch (4);

f) reeling out a length wire or cable (5) from the storage drum (2), the length corresponding to the length of discarded wire or cable (5) and the length of temporarily stored wire on the storage drum (2); and g) securing the wire or cable (5) to the deadline anchor (3).

In an embodiment of the present invention, the method comprises in step b) an additional step of adjusting the hydraulic operation of the storage drum so that the wire or cable is held substantially tensioned between the deadline anchor and storage drum.

In an embodiment of the present invention, the method comprises in step f) a further step of adjusting the hydraulic operation of the storage drum so that the wire or cable is held substantially tensioned from the storage drum.

In an embodiment of the present invention, the method comprises in step d) a further step of reeling off remaining wire or cable from the winch.

A non-limiting embodiment of the present invention will now be described below under reference to the accompanying drawings wherein like items are given like reference numerals.

FIG. 1 shows a schematic view of a land or offshore based drilling rig (not shown), where drilling rig comprises a derrick 1 with a hoisting system and an arrangement for a winch, where the derrick 1 is used for lifting and lowering of pipes and other equipment in a well. The hoisting system includes a storage drum 2 and a deadline anchor 3, wherein the storage drum 2 and the deadline anchor 3 are arranged on a deadline side of the hoisting system. A winch 4, comprising a drum, is further arranged on a fastline side of the hoisting system. A wire or cable 5 extends from the winch 4 and over at least one sheave 6 in the derrick 1, via a traveling block 7, further over at least one sheave 6 in the derrick 1 and further via the deadline anchor 3 and to the storage drum 2, so as to provide a connection between the deadline side and the fastline side of the hoisting system.

During normal use of the hoisting system, the deadline anchor 3 will be locked to prevent it from rotating, and the winch 4 is used for lifting and/or lowering pipes and/or other equipment in the well. Locking the deadline anchor 3 may, for example, be done by using locking bolts (not shown) etc., where the locking bolts then lock the drum 31 of the deadline anchor 3 to the deadline anchor foundation 32.

When the wire or cable has been in use for a number of ton-miles in a hoisting system as described above, a certain length of the wire or cable 5 is "replaced", due to wear and/or bending of the wire or cable 5, whereby the replacement is performed via a so-called "cut and slip" procedure. Such wear or bending of the wire or cable 5 most often occurs near the sheaves 6, in the crown block, and the traveling block 7, and when entering the drum of the winch 4 etc.

A method for replacing at least a section of a wire or cable 5 in a hoisting system according to the present invention will now be described in relation to FIGS. 2-7.

Figure 2:
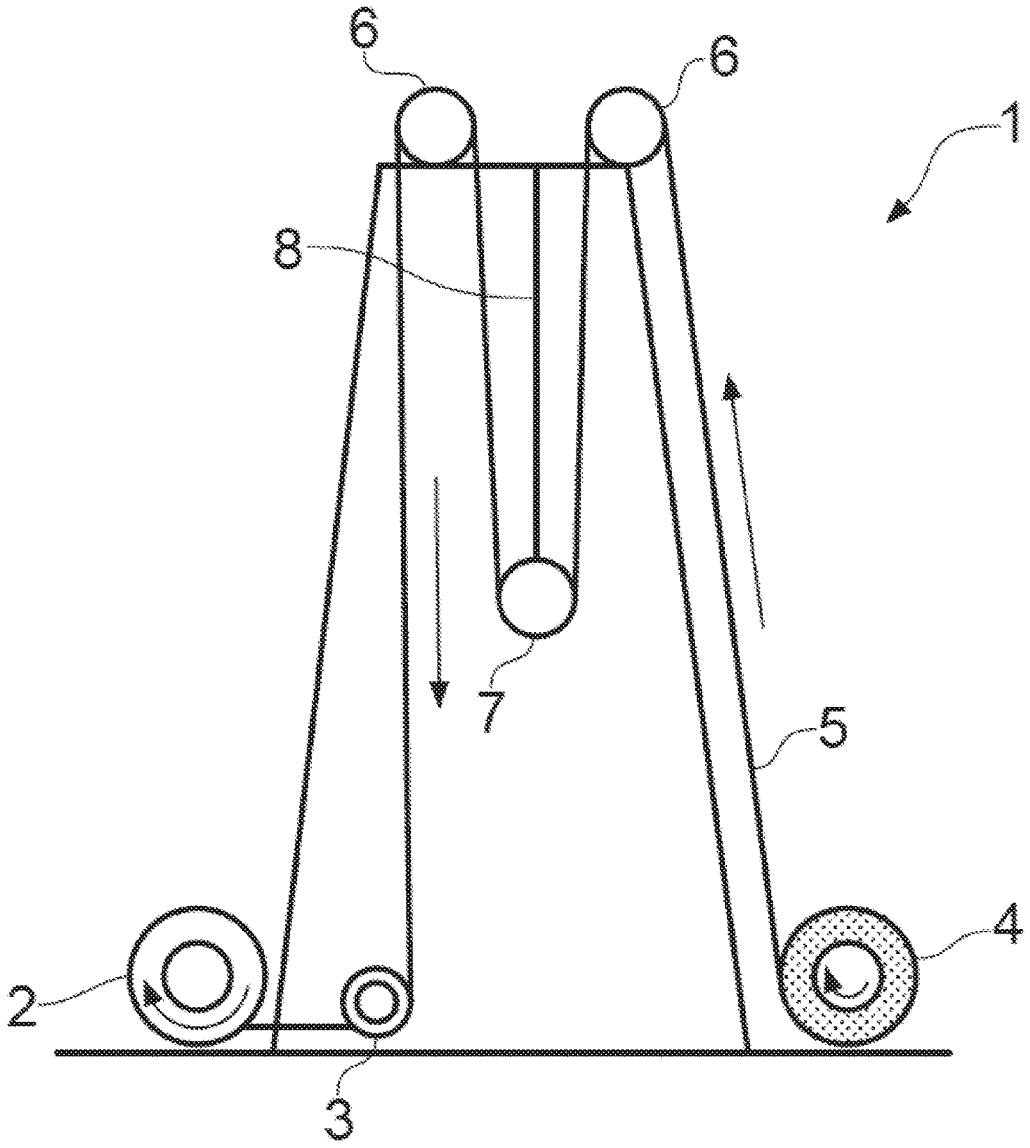
FIG. 2 shows steps in a "cut and slip" procedure according to the present invention including where the locking pins (not shown) locking the drum of the deadline anchor to the deadline anchor foundation are removed, and where weight is then taken off the wire or cable by a hang off wire supporting the weight of the travelling block and holding the travelling block in a predetermined position in the derrick.

In FIG. 2, the locking pins (not shown) locking the drum 31 of the deadline anchor 3 to the deadline anchor foundation 32 are removed. Weight is then taken off the wire or cable 5 by a hang off wire 8, supporting the weight of the travelling block 7 and holding the traveling block 7 in a predetermined position in the derrick 1. Since the deadline anchor 3 and storage drum 2 are connected to each other through a hydraulic drive system, which will be explained further in relation to FIG. 9, one person will be able to operate both storage drum 2 and deadline anchor 3 simultaneously. By the use of hydraulic drives on both storage drum 2 and the deadline anchor 3, the wire or cable 5 can be reeled off the winch 4 and onto the storage drum 2. The hydraulic operation of the storage drum 2 can be adjusted to maintain some tension in the wire or cable 5 between the deadline anchor 3 and storage drum 2.

Wire or cable 5 will be reeled from the winch 4 to the storage drum 2 until a minimum number of turns of wire or cable 5 is left on the drum of the winch 4. The length of reeled wire or cable 5 onto the storage drum 2 will be approximately 60 m, while approximately 30 m will be left on the drum of the winch 4.

Figure 3:
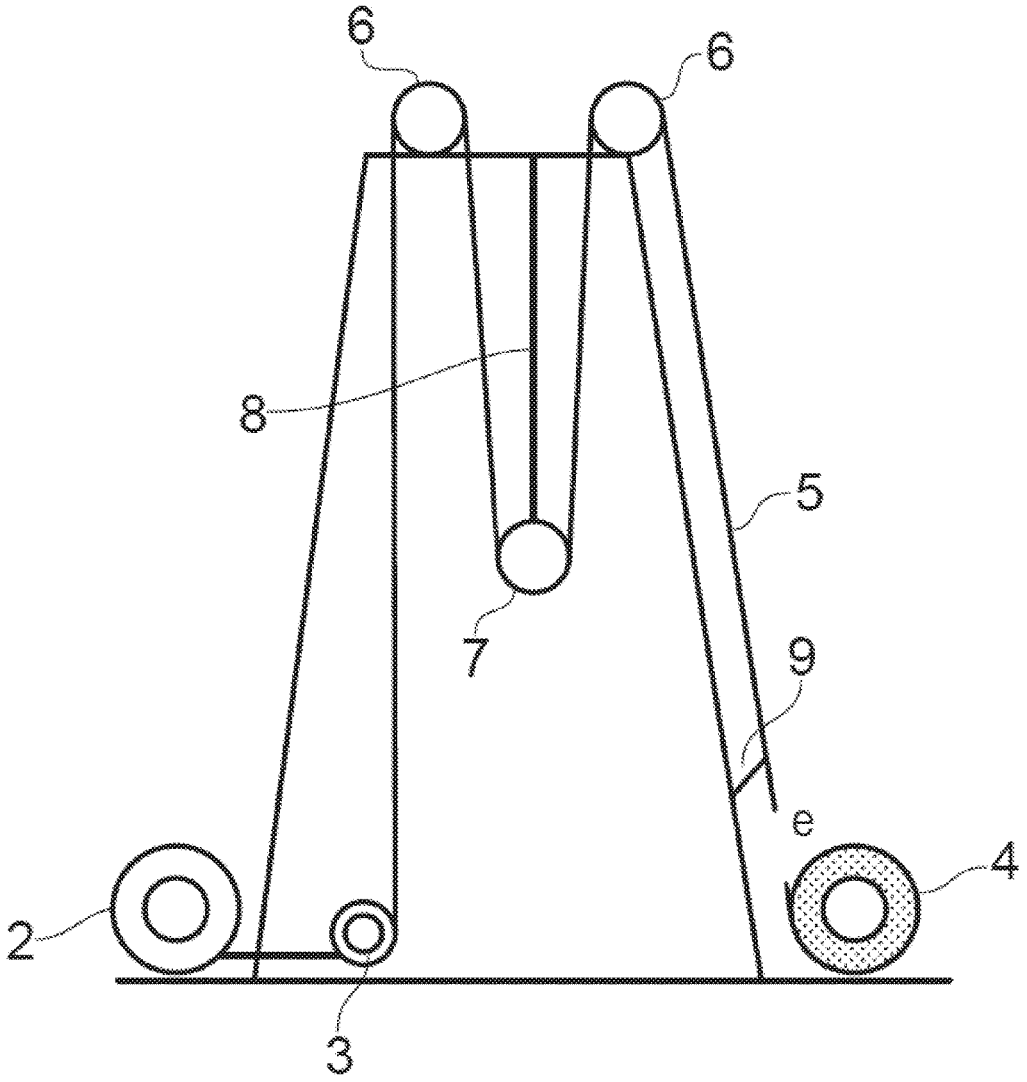
FIG. 3 shows steps in a "cut and slip" procedure according to the present invention including where the wire or cable is temporary fastened to the derrick by an attachment point provided at a distance from the winch, and where the wire or cable is then cut below the attachment point.

FIG. 3 shows that, when the above specified length of the wire or cable 5 is reeled on to the storage drum 2 and there is about 30 m of wire or cable 5 remaining on the drum 31 of the winch 4, the wire or cable 5 will be temporary fastened to the derrick 1 by an attachment point 9, whereby the attachment point 9 is provided at a distance from the winch 4. The wire or cable 5 will subsequently be cut below the attachment point 9. The cutting of the wire or cable 5 is carried out so that a free end of the wire or cable 5, after cutting, is sufficiently long to allow the wire or cable 5 to be mounted in a wireline or cable lock (not shown) in the drum of the winch 4.

Figure 4:
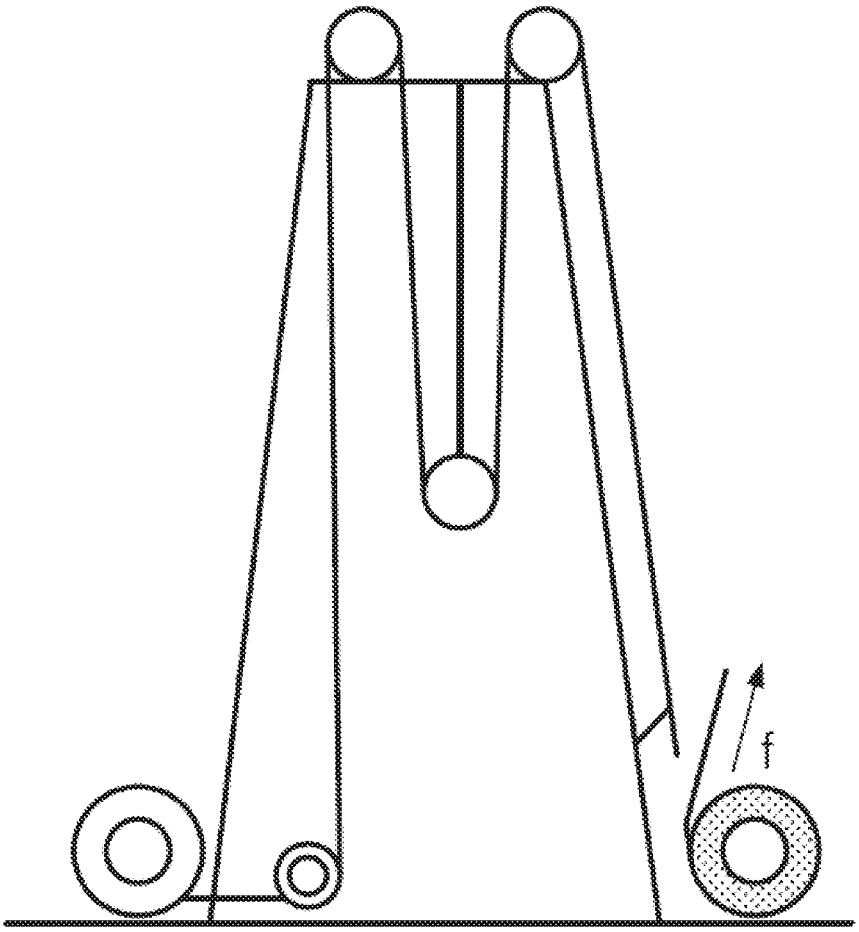

FIG. 4 shows that the remaining length of the wire or cable 5 on the winch 4 is reeled off and disposed of in an appropriate manner.

Figure 5:
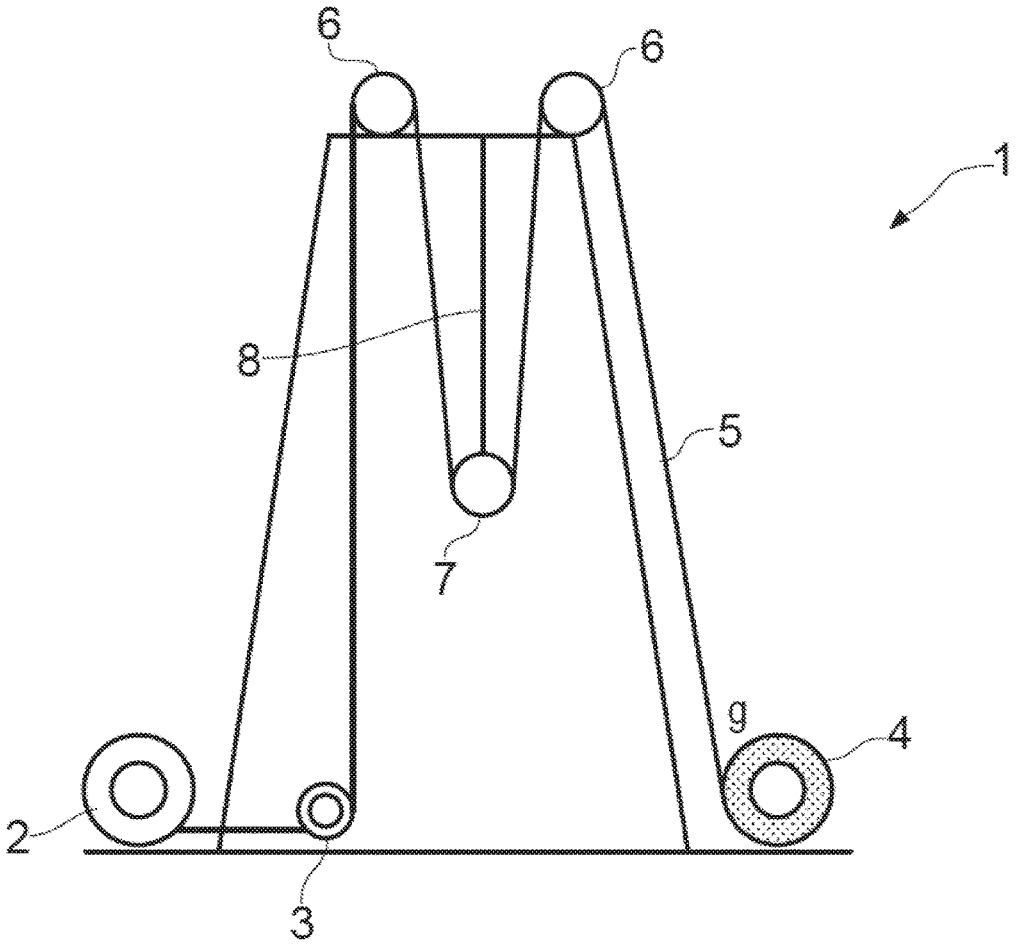
FIG. 5 shows steps in a "cut and slip" procedure according to the present invention including where the free end of the wire or cable is moved to the winch and is installed in the wire or cable lock (not shown) in the drum of the winch.

FIG. 5 shows that the free end of the wire or cable 5 is moved to the winch 4 and installed in the wire or cable lock (not shown) in the drum of the winch 4.

Figure 6:
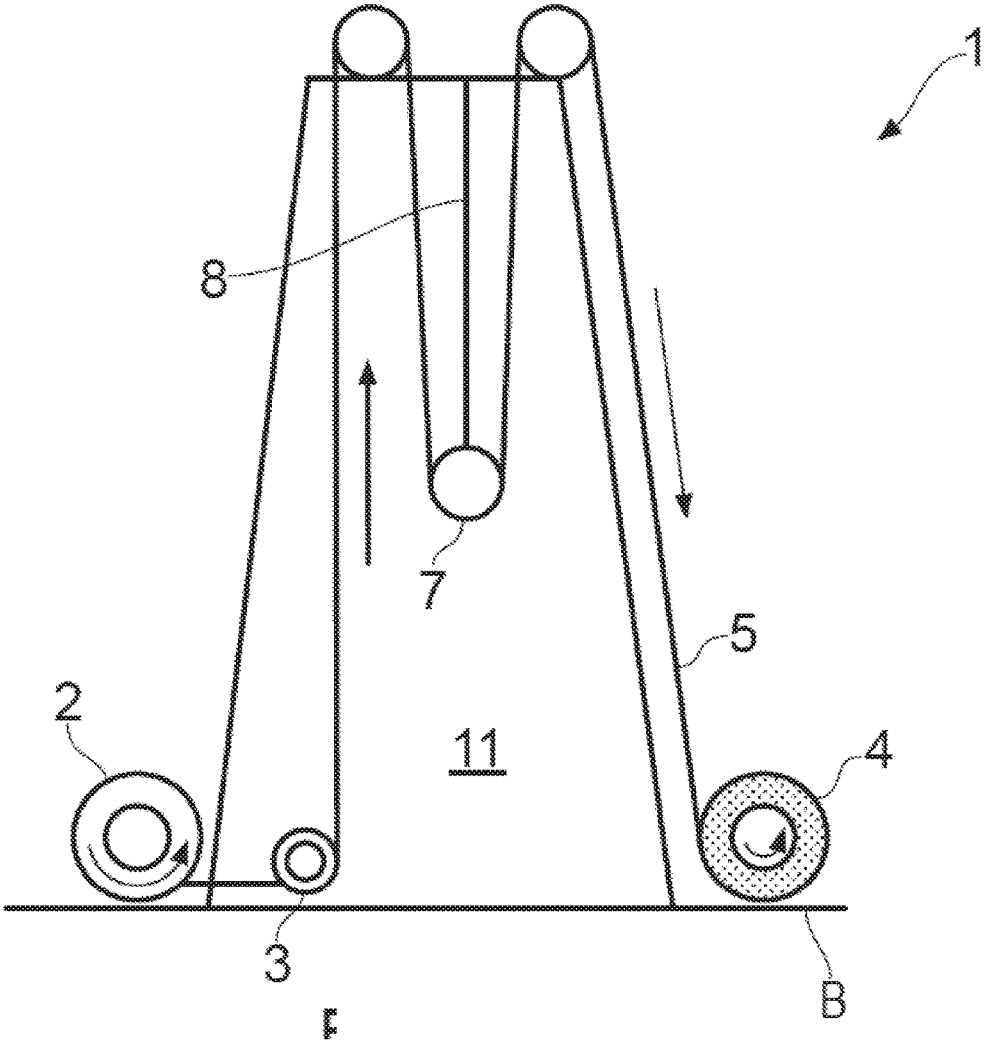
FIG. 6 shows steps in a "cut and slip" procedure according to the present invention including where the winch is used to reel on wire or cable from the storage drum and to the winch drum.

FIG. 6 shows that the winch 4 is used to reel on wire or cable 5 from the storage drum 2 and to the winch drum. A length of wire or cable 5 equivalent to approximately 5 turns of wire or cable 5 on the winch drum and a length of wire or cable 5 that is needed to lower the traveling block 7 from the suspension point and down to the drill floor B is reeled onto the winch 4. This length is approximately 90 m. The wire or cable 5 is held in continuous tension from the storage drum 2 by adjusting the hydraulic drive of the storage drum 2 and the deadline anchor 3. This provides that the wire or cable 5 will be reeled correctly over the sheaves 6, the traveling block 7, and the drum of the winch 4.

Figure 7:
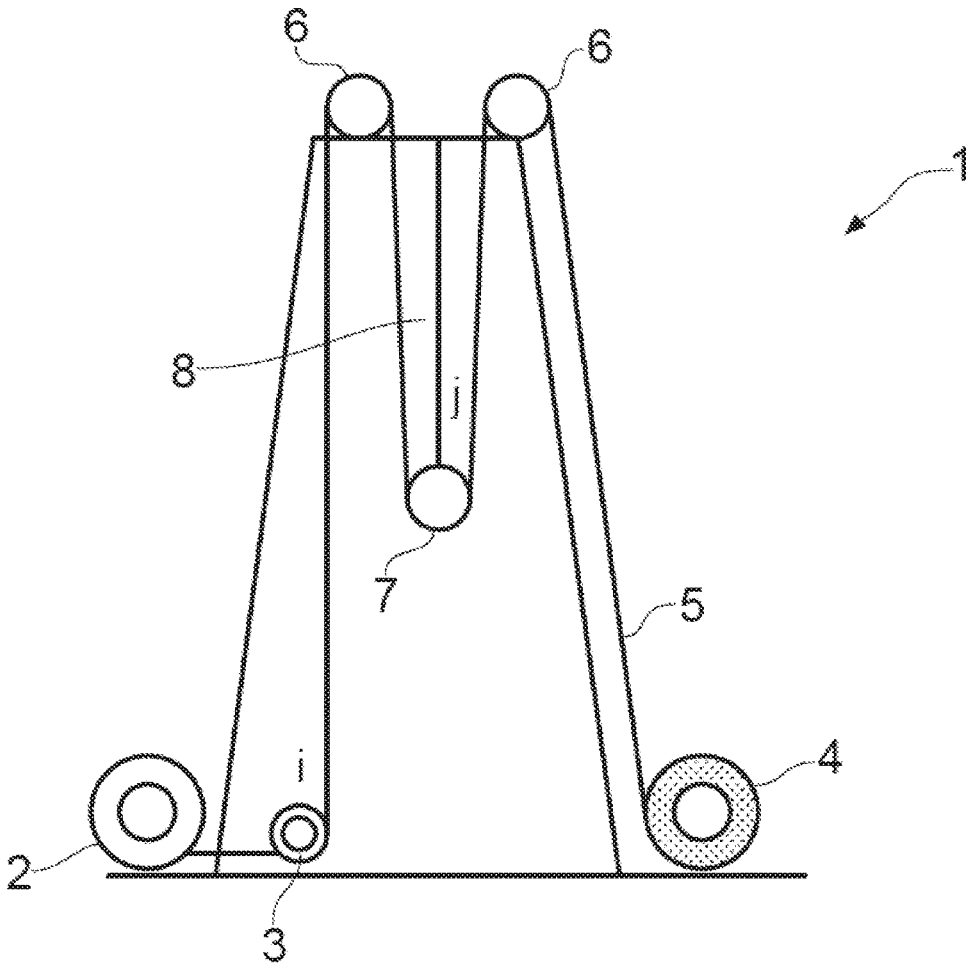
FIG. 7 shows steps in a "cut and slip" procedure according to the present invention including where a length of wire or cable is reeled off from the storage drum.

FIG. 7 shows that the correct length of wire or cable 5 is reeled off from the storage drum 2. The deadline anchor 3 will again be locked by the locking bolts (not shown) locking the drum 31 of the deadline anchor 3 to the base 32 of the deadline anchor 3. Finally, the hang off wire 8 will be removed from the traveling block 7. The hoisting system is then again operational, but with the strained sections of the wire or cable 5 having been moved to less loaded sections of the drill line 5.

Figure 8:
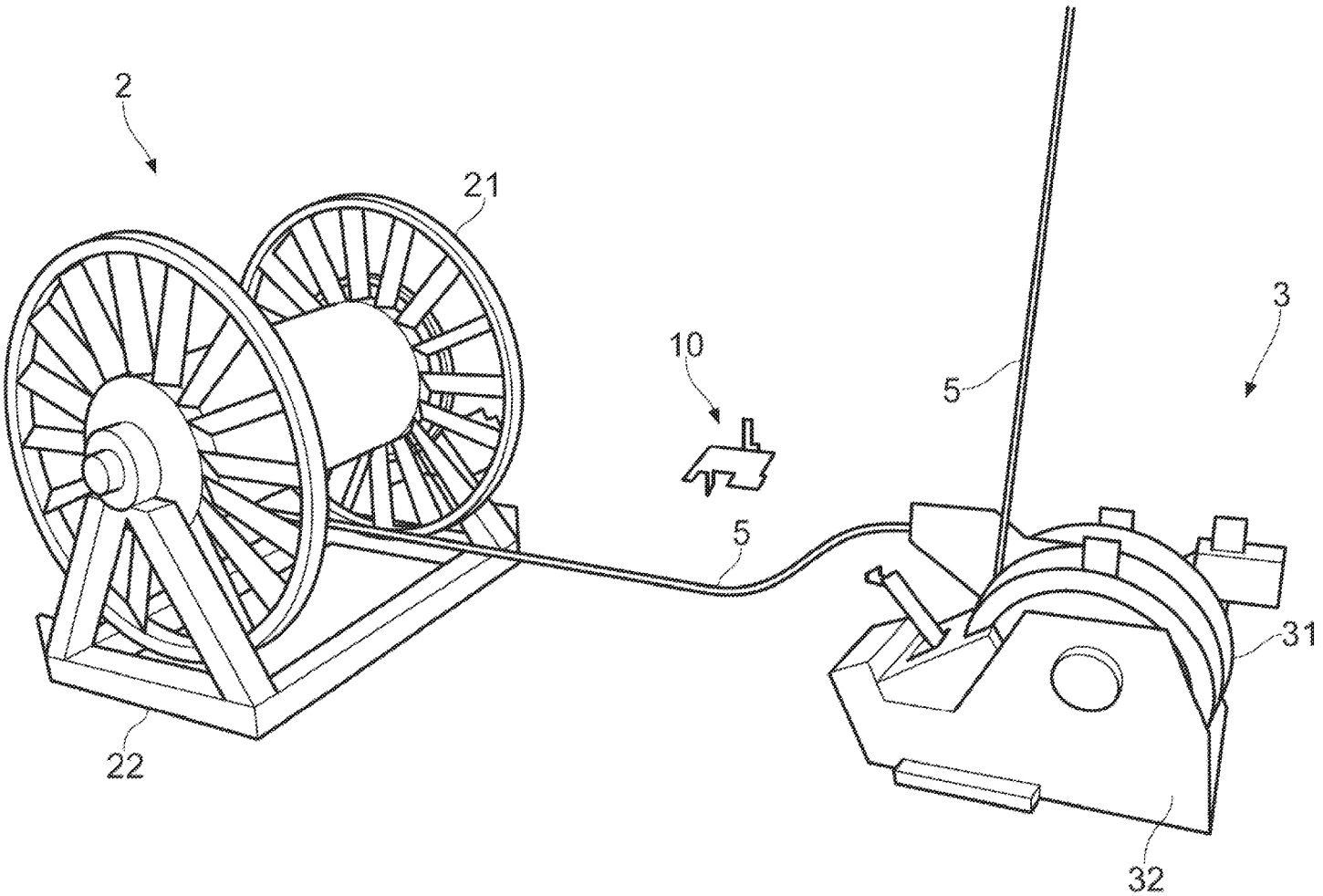
FIG. 8 shows an arrangement for a winch according to the present invention.

FIG. 8 shows an arrangement related to the hoisting system of the present invention where, in connection with the deadline anchor 3, a storage drum 2 is also used, whereby the deadline anchor 3 and the storage drum 2 are connected by a hydraulic system 12 (see FIG. 9) connected to a control device 10. The deadline anchor 3 and the storage drum 2 are each equipped with a plurality of hydraulic motors (not shown) which allow the deadline anchor 3 and storage drum 2 to rotate in both directions (clockwise and counter-clockwise). One operator (not shown) can thereby use the control device 10 to control reeling, unreeling, the force which the storage drum 2 applies to the wire or cable 5, etc. in order to obtain a correct installation of the wire or cable 5.

Storage drum 2 comprises a tire 21 and a base 22. The deadline anchor 3 comprises a drum 31 and a base 32, where the drum 31 and the base 32 are designed so that the drum 31 can be locked to the base 32 when the hoisting system is operational (in normal operation).

Figure 9:
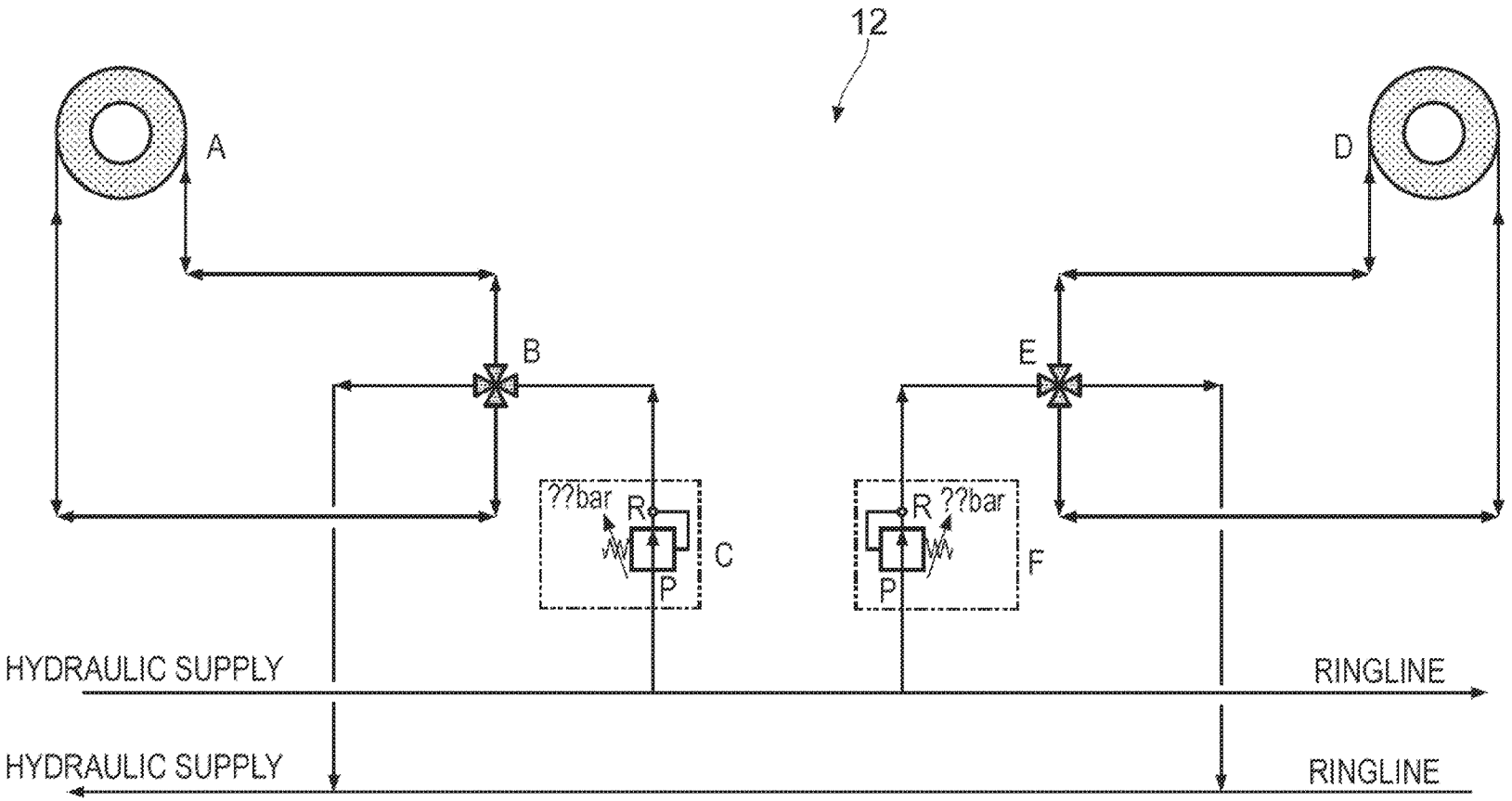
FIG. 9 shows details of a hydraulic system according to the present invention.

FIG. 9 shows the hydraulic system 12 which controls the deadline anchor 3 and the storage drum 2. Hydraulics are supplied from a hydraulic pump unit (not shown) which normally has a working pressure of approximately 210 bar. The power to a hydraulic motor A, which controls the deadline anchor 3, and a hydraulic motor D, which controls storage drum 2, is regulated by pressure control valves C and F, where the pressure control valve C regulates the pressure to the hydraulic motor A for the deadline anchor 3 and pressure control valve F regulates the pressure to the hydraulic motor D for the storage drum 2, respectively. The hydraulic flow is further led to a 4-way valve B and E, where the 4-way valve B is used for the deadline anchor 3 and the 4-way valve E for storage drum 2, which both regulate the direction of rotation of hydraulic motors A, D and the speed of hydraulic motors A, D. By controlling the power, speed and rotation direction of the hydraulic motors A, D, an approximately constant tension on the wire or cable 5 between the storage drum 2 and the deadline anchor 3 during reeling operations can be maintained. The deadline anchor 3 acts as a winch in these operations. Because there are only three turns of wire or cable 5 on the deadline anchor drum 31, the wire or cable 5 may be displaced continuously laterally, one wire or cable thickness, by guide devices (not shown) which push the wire or cable 5 laterally on the drum 31 of deadline anchor 3, and thereby provide space for new wire or cable 5 which is reeled on. The tensioning of the wire or cable 5 between the storage drum 2 and the deadline anchor 3 for this reason must not be too high, so that lateral displacement of the wire or cable 5 is achieved.

The embodiments described herein are intended for illustrative purposes and are not be deemed to be in any way limiting. A person skilled in the art can make modifications or alterations to the invention without departing from the scope of the present invention as defined in the appended claims. The individual steps of the procedure may, for example, in some cases be performed in a different order than other steps. It is also understood that the specified lengths of wire or cable that is spooled on or off the storage drum and/or the winch may vary, depending on the hoisting system lifting height, the drum diameter of the storage drum and/or winch drum, the number of sheaves and lines and/or the traveling block and drilling machine size etc. Reference should also be had to the appended claims.

What is claimed is:

1. A method for replacing a length of a wire or cable in a hoisting system, the wire or cable extending from a storage drum at a first end to a winch at a second end, the method comprising:

removing at least one lock which prevents a deadline anchor arranged between the storage drum and the winch from rotating;

reeling onto the storage drum a first length of the wire or cable with a simultaneous coordinated operation of the deadline anchor and the storage drum, the simultaneous coordinated operation being controlled so that the wire or cable is in a continuous tension between the deadline anchor and the storage drum;

securing the wire or cable to an attachment point;

cutting a section of the wire or cable between the attachment point and the winch and removing the cut section of the wire or cable from the winch;

discarding the cut section of the wire or cable which has been removed from the winch;

detaching the wire or cable from the attachment point and reattaching the wire or cable remaining to the winch;

reeling out wire or cable onto the winch from the storage drum; and securing the wire or cable to the deadline anchor.

2. The method as recited in claim 1, wherein a length of the wire or cable reeled out onto the winch from the storage drum corresponds to at least one of a length of the section of wire or cable which was cut and removed from the winch and to a length of the wire or cable which is temporarily stored on the storage drum.

3. The method as recited in claim 1, wherein the removing of the at least one lock which prevents the deadline anchor arranged between the storage drum and the winch from rotating further comprises:

adjusting a hydraulic operation of the storage drum so that the wire or cable is held substantially tensioned between the deadline anchor and storage drum.

4. The method as recited in claim 1, wherein the reeling out of the first length of the wire or cable from the storage drum further comprises:

adjusting a hydraulic operation of the storage drum so that the wire or cable is held substantially tensioned from the storage drum.

5. The method as recited in claim 1, wherein the step of cutting the section of the wire or cable between the attachment point and the winch and removing the cut section of the wire or cable further comprises:

reeling off the wire or cable remaining from the winch.

* * * * *